US009897408B2

(12) United States Patent
Liao

(10) Patent No.: US 9,897,408 B2
(45) Date of Patent: Feb. 20, 2018

(54) POWER SAVING ACTION MODULE FOR TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 15/591,119

(22) Filed: May 10, 2017

(65) Prior Publication Data

US 2017/0328670 A1 Nov. 16, 2017

(30) Foreign Application Priority Data

May 13, 2016 (TW) ..... 105207004 U

(51) Int. Cl.
*F41B 11/00* (2013.01)
*F41B 11/71* (2013.01)
*F41B 11/89* (2013.01)

(52) U.S. Cl.
CPC ..... *F41B 11/71* (2013.01); *F41B 11/89* (2013.01)

(58) Field of Classification Search
CPC ..... F41B 11/00; F41B 11/55; F41B 11/57; F41B 11/71
See application file for complete search history.

(56) References Cited

U.S. PATENT DOCUMENTS 6,568,381 B2 * 5/2003 Chang ..... F41A 19/59 124/32
7,293,385 B2 * 11/2007 McCormick ..... F41A 19/10 124/31
8,887,708 B2 * 11/2014 Kantonides ..... F41B 11/71 124/77
8,893,695 B2 * 11/2014 Liao ..... F41B 11/71 124/27
9,022,014 B2 * 5/2015 Hu ..... F41B 11/71 124/32
2015/0176942 A1 * 6/2015 Hu ..... F41B 11/71 124/32

* cited by examiner

*Primary Examiner* — John Ricci
(74) *Attorney, Agent, or Firm* — Leong C. Lei

(57) ABSTRACT

The action module includes an action member, a switch element, and an activation element. The action member includes a power provision device. The switch element is on the action member electrically connected to the power provision device, and includes a switch trigger. The activation element is rotatably configured on the action member adjacent to the switch element, and includes a magazine contact part to be pressed or released when a magazine is mounted to or removed from the action module, and a switch engaging part for engaging the switch trigger. As such, by the interaction between the switch element and the activation element, the toy gun does not function as long as the magazine is not mounted, and therefore electrical power will not be wasted. The action module may work with any type of magazines.

8 Claims, 7 Drawing Sheets

POWER SAVING ACTION MODULE FOR TOY GUN

BACKGROUND OF THE INVENTION

(a) Technical Field of the Invention

The present invention generally relates to toy guns and, more particularly, to an action module for toy guns providing enhanced power saving.

(b) Description of the Prior Art

Military simulation games are gaining popularity and various types of replica weapons called airsoft guns are developed and marketed, such as gas-powered, high-pressure air (HPA) powered, electrically powered airsoft guns, for shooting pellets.

Automatic electric guns (AEGs) are a type of electrically powered airsoft guns. An AEG is usually equipped with a safety power switch to prevent a waste of electrical power when no magazine is installed in the AEG.

This type of AEGs requires that the gun's action mechanism has to be tightly integrated with the magazine. Otherwise it is not possible to turn on or off the power. However, for greater flexibility and for lower cost, it would be better to have modularized action mechanism and magazine so that various combinations of the action mechanisms and magazines may be achieved.

SUMMARY OF THE INVENTION

Therefore, a novel action module for toy guns is provided so that the mount and dismount of a magazine to the toy gun would turn on and off the toy gun's power.

A major objective of the present invention is to provide an action module having a switch element to the toy gun's power and an activation element where the magazine engages the activation element, which in turn engages the switch element so as to turn and off the gun's power. Therefore, when no magazine is mounted, the gun does not function and as such electrical power is conserved.

The action module includes an action member, a switch element, and an activation element. The action member includes a power provision device. The switch element is on the action member electrically connected to the power provision device, and includes a switch trigger. The activation element is rotatably configured on the action member adjacent to the switch element, and includes a magazine contact part to be pressed or released when a magazine is mounted to or removed from the action module, and a switch engaging part for engaging the switch trigger. As such, by the interaction between the switch element and the activation element, the toy gun does not function as long as the magazine is not mounted, and therefore electrical power will not be wasted. The action module may work with any type of magazines.

Compared to the prior art where a modularized toy gun cannot turn on and off the gun power to save energy, the present invention has successfully overcome such limitation, thereby achieving reduced cost of ownership and greater flexibility.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
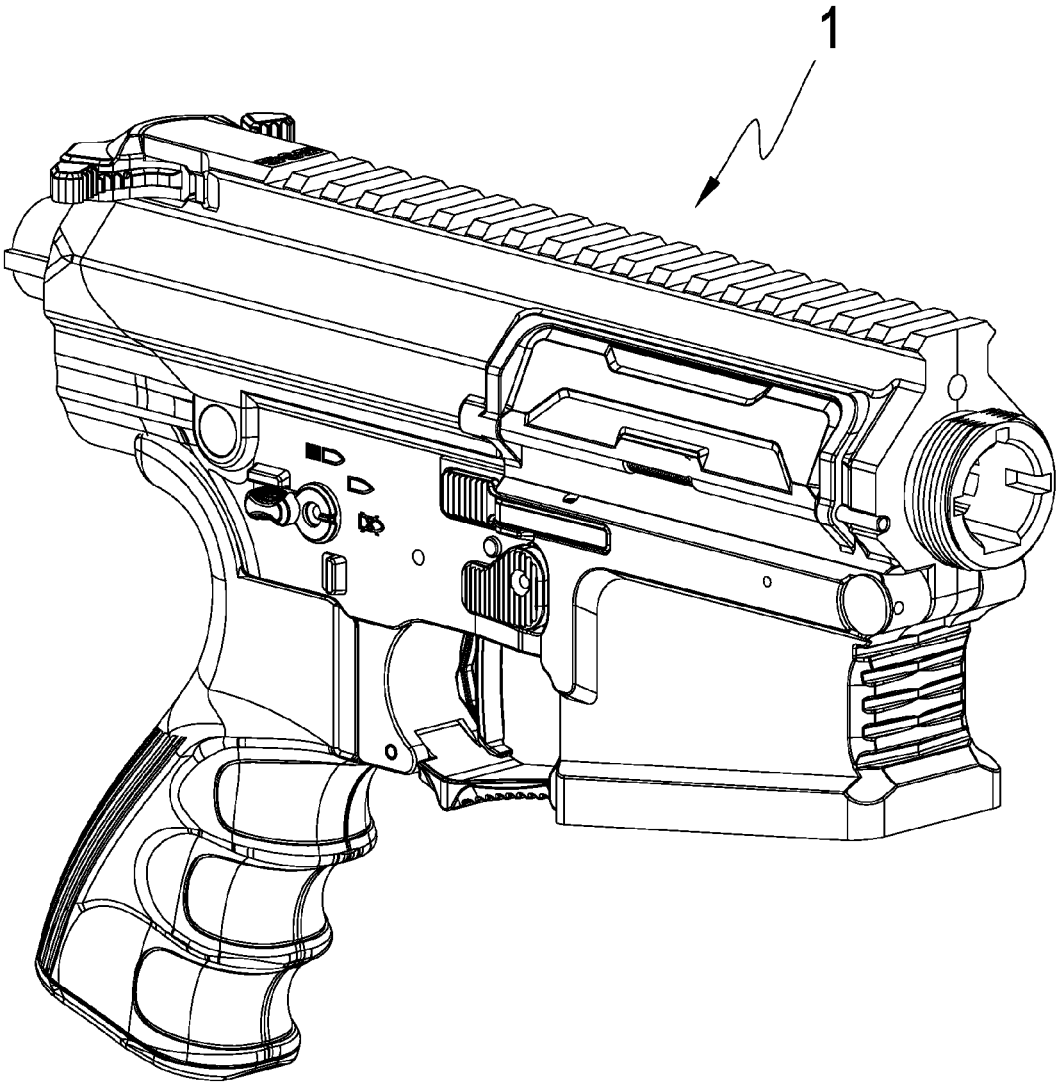
FIG. 1 is a perspective diagram of an action module according to an embodiment of the present invention.
Figure 2:
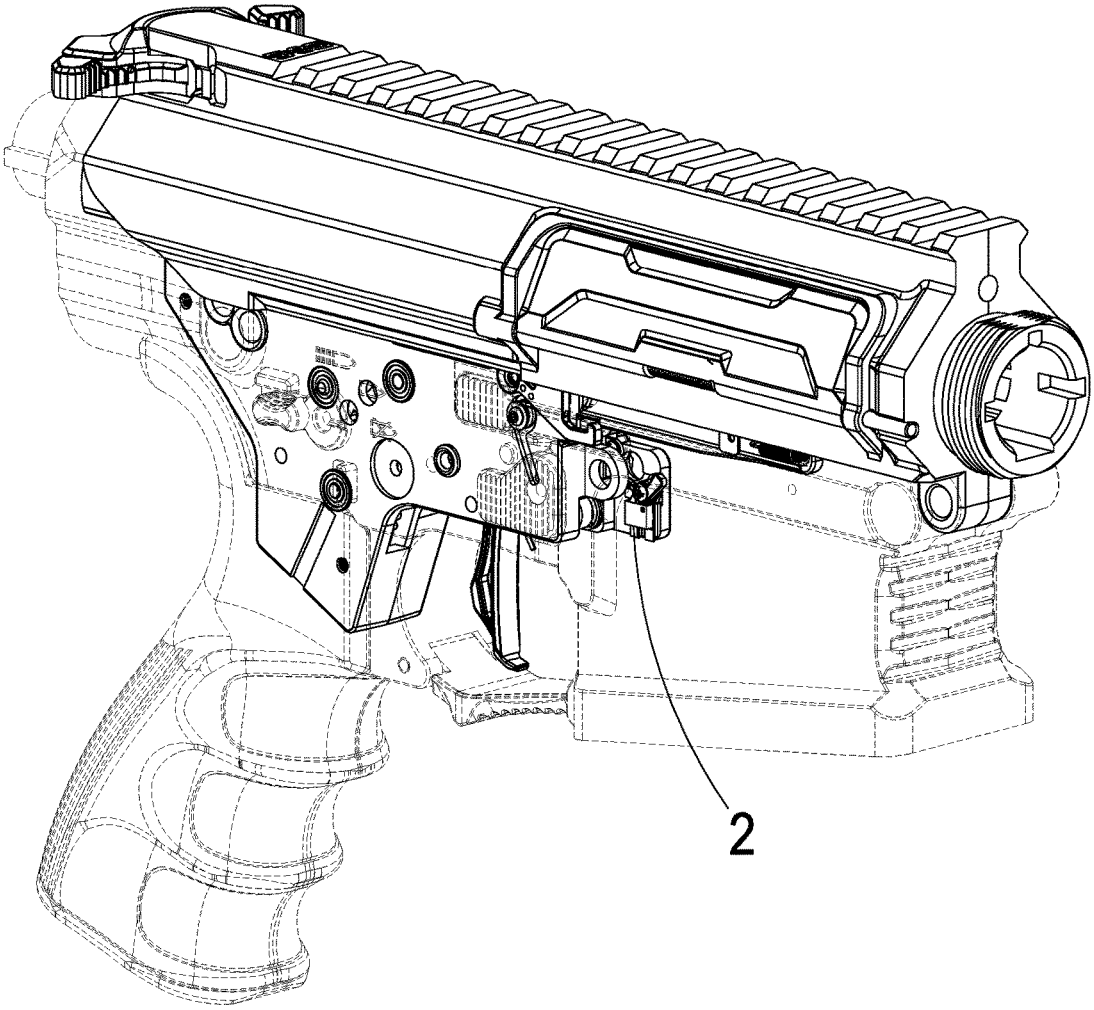
FIG. 2 is a perspective schematic diagram showing the action module of FIG. 1.
Figure 3:
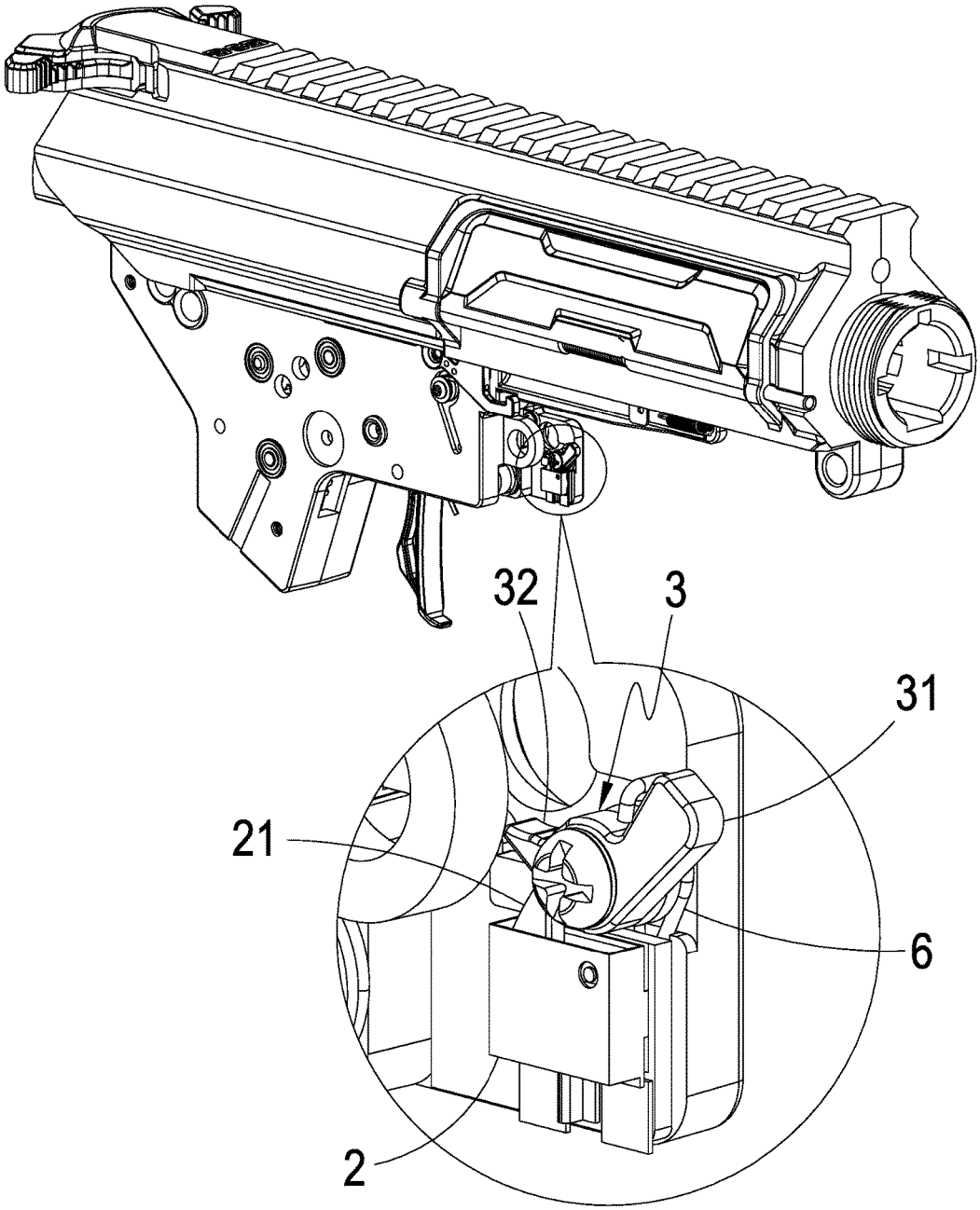
FIG. 3 is a schematic enlarged diagram showing a switch element and an activation element of the action module of FIG. 1.

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 4, an action module for toy guns according to an embodiment of the present invention includes the following components.

There is an action member 1 which includes a trigger and at least a power provision device that is engaged by a gun trigger 5.

There is a switch element 2 on the action member 1 electrically connected to the power provision device. The switch element 2 includes a switch trigger 21.

There is an activation element 3 rotatably configured on the action member 1 adjacent to the switch element 2. The activation element 3 includes a magazine contact part 31 to be pressed or released when a magazine is mounted or removed, a switch engaging part 32 for engaging the switch trigger 21, and a pivot part 33 located between the magazine contact part 31 and the switch engaging part 32. The rotation of the activation element 3 around the pivot part 33 would engage an elastic element 6 configured between the activation element 3 and the action member 1. The elastic element 6 is for restoring the activation element 3 to an initial orientation after the activation element 3 is turned.

The magazine contact part 31 is located along a path along which the magazine is mounted or removed.

Figure 4:
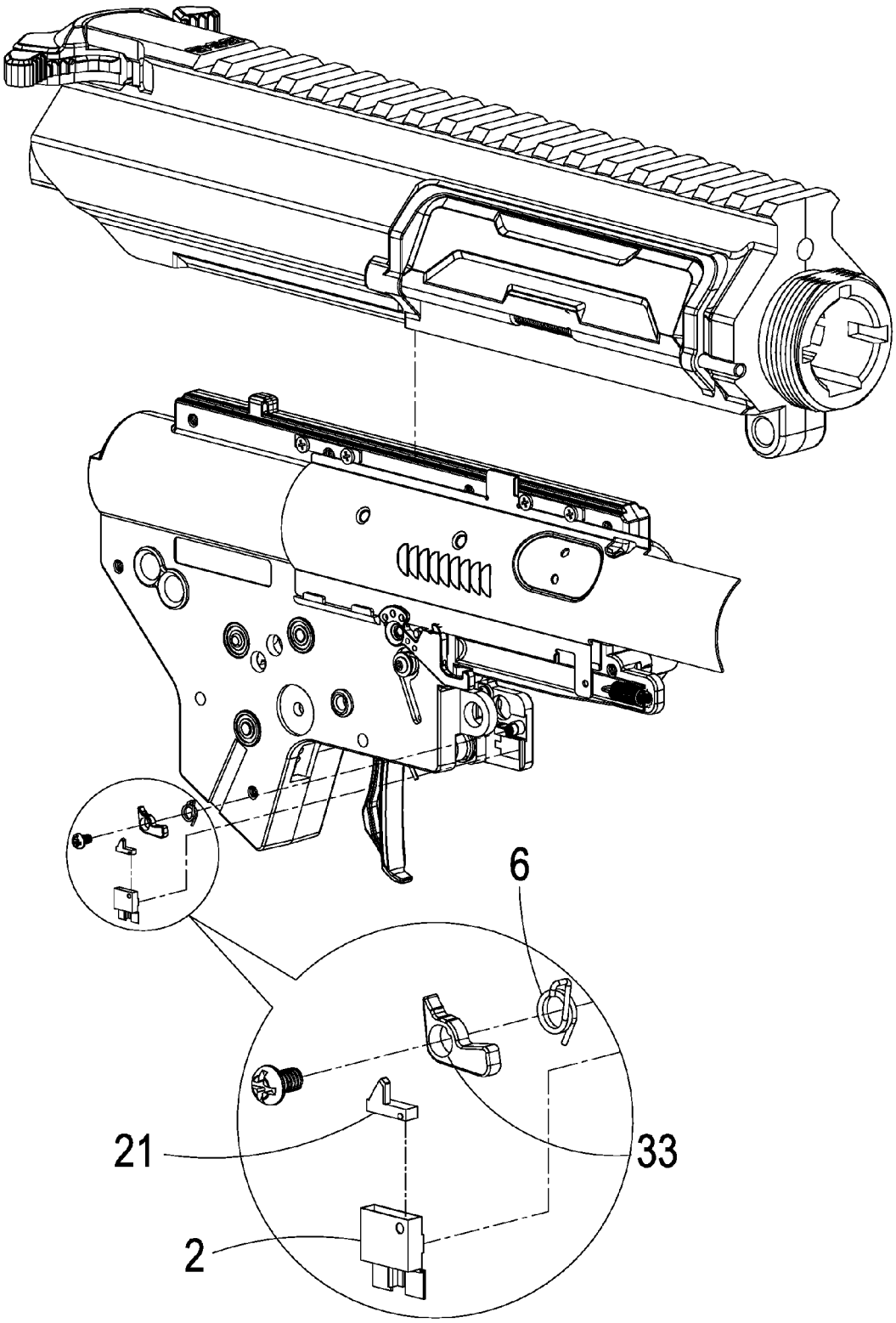
FIG. 4 is a perspective break-down diagram of the switch element and the activation element of FIG. 3.
Figure 4A:
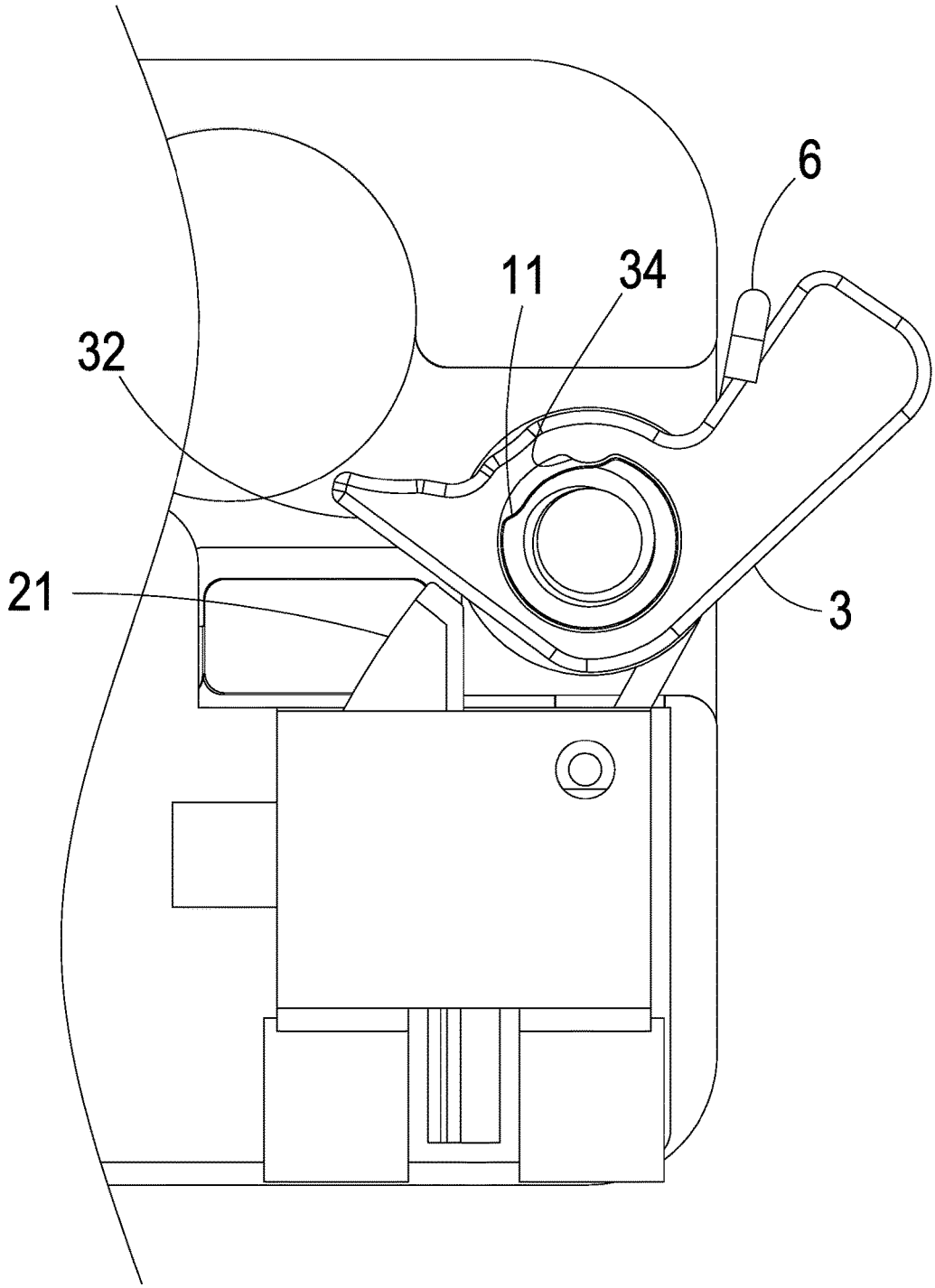
FIG. 4A is a schematic sectional diagram showing the switch element and the activation element when no magazine is mounted.
Figure 5:
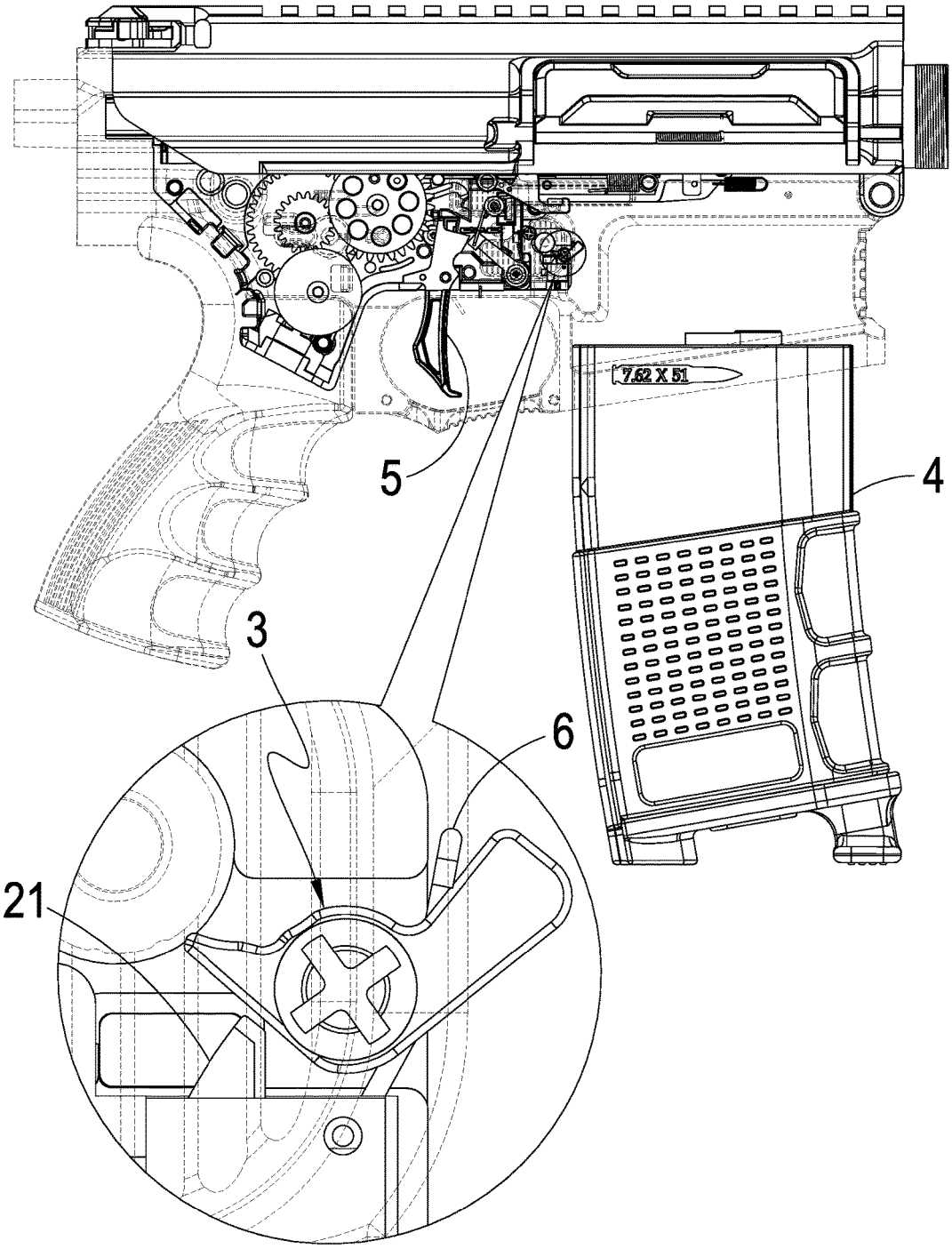
FIG. 5 is a schematic side-view diagram showing the action module of FIG. 1 when a magazine is mounted.
Figure 6:
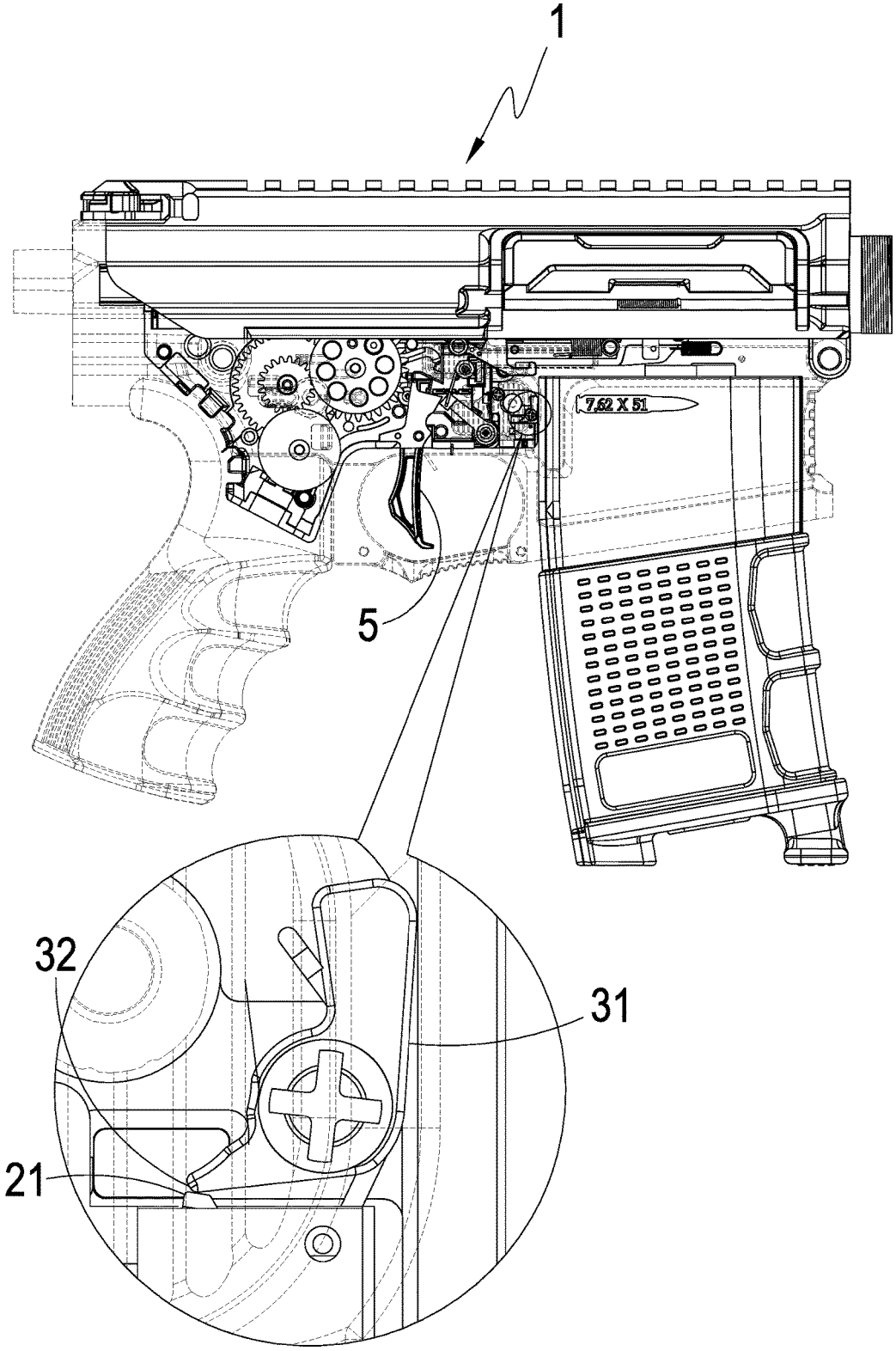
FIG. 6 is a schematic side-view diagram showing the action module of FIG. 5 when the magazine is completely mounted.

As shown in FIG. 4A, when no magazine is mounted, the activation element 3, under the influence of the elastic element 6, is turned clockwise so that the magazine contact part 31 is extended into the path along which the magazine is mounted or removed, and the switch engaging part 32 is distant from the switch trigger 21. The rotation of the activation element 3 is jointly confined by a limiting part 34 on the activation element 3 and a stopper element 11 on the action member 1 located around where the pivot part 33 pivotally joined to the action member 1. As the switch element 2 is not engaged to turn on the power provision device, the gun trigger 5 (shown in FIGS. 5 and 6) of the action member 1 does not function. Then, as shown in FIG. 5, when the magazine 4 is mounted to the action member 1, it pushes the magazine contact part 31 so that the activation element 3 turns counterclockwise, the switch engaging part 32 engages the switch trigger 21, the switch element 2 turns on the power provision device, and the gun trigger 5 now functions to fire pellets.

On the other hand, as the magazine 4 is removed and pulled away from the magazine contact part 31, the elastic element 6 gradually turns the activation element 3 clockwise away from the switch trigger 21. When the magazine 4 is completely removed, the restoration of the activation element 3 is stopped by the blocking from the stopper element 11 on the limiting part 34. At this point, the switch engaging part 32 is entirely moved away from the switch trigger 21. As such, the power provision device is turned off by the switch element 2 and the gun trigger 5 does not function.

The action module of the present invention may be applied to an electrically powered gun, a gas powered gun, a paintball gun, or an air gun. As a matter of fact, the action module may apply to any gun involving electrical power.

Compared to the prior art, the present invention has the following advantages.

Firstly, by the interaction between the switch trigger 21 of the switch element 2 and the switch engaging part 31 of the activation element 3, the action member 1 does not function as long as the magazine 4 is not mounted.

Secondly, therefore, electrical power will not be wasted when no magazine 4 is mounted.

Thirdly, the switch element 2 and the activation element 3 are all configured in the action member 1. As such, there is no limitation on the types of the magazines 4 used. Any type of magazine 4, once mounted, may turn on or off the power of the gun.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An action module for a toy gun, comprising:

an action member comprising a power provision device;

a switch element on the action member electrically connected to the power provision device, where the switch element comprises a switch trigger; and an activation element rotatably configured on the action member adjacent to the switch element, where the activation element comprises a magazine contact part to be pressed or released when a magazine is mounted to or removed from the action module, and a switch engaging part for engaging the switch trigger.

2. The action module according to claim 1, wherein the power provision device is engaged by a gun trigger of the toy gun.

3. The action module according to claim 1, wherein the magazine contact part is located along a path along which the magazine is mounted or removed.

4. The action module according to claim 1, wherein the activation element further comprises and a pivot part located between the magazine contact part and the switch engaging part.

5. The action module according to claim 1, further comprising an elastic element coupled to the activation element.

6. The action module according to claim 1, wherein the toy gun is one of an electrically powered gun, a gas powered gun, a paintball gun, and an air gun.

7. The action module according to claim 1, wherein the action member further comprises a stopper element located around where the activation element rotatably joined to the action member.

8. The action module according to claim 7, wherein the activation element further comprises a limiting part for engagement with the stopper element so as to confine the rotation of the activation element.

* * * * *